US005467177A

United States Patent [19]

Iwama et al.

[11] Patent Number: 5,467,177

[45] Date of Patent: Nov. 14, 1995

[54] FIXING METHOD FOR PRINTING MACHINE AND ELECTROPHOTOGHRAPHIC PRINTING MACHINE

[75] Inventors: Ryoichi Iwama; Akira Yamada, both of Kawasaki, Japan

[73] Assignee: Fujitsu Limited, Kawasaki, Japan

[21] Appl. No.: 229,872

[22] Filed: Apr. 19, 1994

[30] Foreign Application Priority Data

Sep. 9, 1993 [JP] Japan ..... 5-224792

[51] Int. Cl.[6] ..... G03G 15/20

[52] U.S. Cl. ..... 355/282; 355/285

[58] Field of Search ..... 355/282, 285, 355/286, 288, 233, 309; 219/216, 388

[56] References Cited

U.S. PATENT DOCUMENTS

| | | | |
|---|---|---|---|
| 4,435,068 | 3/1984 | Landa . | |
| 4,652,110 | 3/1987 | Sato et al. . | |
| 4,884,096 | 11/1989 | Kusuda et al. | 355/233 |
| 4,897,691 | 1/1990 | Dyer et al. | 355/288 |
| 4,945,386 | 7/1990 | Ito et al. | 355/243 |
| 5,065,196 | 11/1991 | Shiga et al. | 355/308 |
| 5,153,738 | 10/1992 | Stemmle | 358/296 |

*Primary Examiner*—R. L. Moses

*Attorney, Agent, or Firm*—Armstrong, Westerman, Hattori, McLeland and Naughton

[57] ABSTRACT

A fixing method for a printing machine includes the steps of (a) forming a latent image on a latent image carrier by a process unit during a time when the latent image carrier is moved in a main scanning direction substantially perpendicular to a direction in which a recording sheet is transported, (b) transferring a visible image corresponding to the latent image onto the recording sheet, and (c) performing a fixing operation on the visible image on the recording sheet at least two times by a fixing device.

12 Claims, 7 Drawing Sheets

FIXING METHOD FOR PRINTING MACHINE AND ELECTROPHOTOGHRAPHIC PRINTING MACHINE

BACKGROUND OF THE PRESENT INVENTION

1. Field of the Invention

The present invention generally relates to electrophotographic printing machines, and more particularly to an electrophotographic printing machine having a fixing device equipped with a carriage which performs printing.

2. Description of the Prior Art

Recently, there has been considerable activity in the development of serial type electrophotographic printing machines equipped with a carriage employing an electrophotographic process in order to achieve reduction in the cost and down-sizing. In such electrophotographic printing machines, an image transfer is performed so that a carriage is moved in the sheet transporting direction and the vertical direction on a transfer device to which a recording sheet is transported, and a transferred image is fixed on the recording sheet by means of a fixing device having rollers arranged in the sheet transporting direction.

In order to achieve further size reduction, electrophotographic printing machines having a carriage equipped with a fixing device have been developed. Such a carriage has a process unit having an electrostatic latent image carrier and a fixing device. Since the fixing device generates a large amount of heat, it is necessary to thermally isolate the electrostatic latent image carrier and the fixing device from each other. For example, the fixing device is cooled by a cooling device. However, the use of such a cooling device prevents down-sizing. Further, a high pressure generated by a roller of the fixing device and applied to the recording sheet is needed to stably perform the fixing process. However, in this case, an oblique motion of the recording sheet or scattering of toner particles will be caused due to high pressure by the roller. In order to reduce these problems, it is necessary to reduce the roller pressure. However, reduction in the roller pressure leads to unstable fixing.

SUMMARY OF THE INVENTION

It is a general object of the present invention to provide an electrophotographic printing machine in which the above disadvantages are eliminated.

A more specific object of the present invention is to provide an electrophotographic printing machine of smaller dimensions capable of stably performing the fixing process in which a process unit having an electrostatic latent image carrier is not thermally affected.

These objects of the present invention are achieved by a fixing method for a printing machine comprising the steps of:

(a) forming a latent image on a latent image carrier by a process unit during a time when the latent image carrier is moved in a main scanning direction substantially perpendicular to a direction in which a recording sheet is transported;

(b) transferring a visible image corresponding to the latent image onto the recording sheet; and (c) performing a fixing operation on the visible image on the recording sheet at least two times by a fixing device.

The above objects of the present invention are also achieved by a printing machine comprising:

transporting means for transporting a recording sheet in a sheet transporting direction;

a carriage comprising process means for forming a latent image on a latent image carrier, and fixing means for performing a fixing operation on a visible image transferred onto the recording sheet at least two times;

transfer means for transferring the latent image to the recording sheet so that the visible image is transferred onto the recording sheet; and moving means for moving the carriage in a main scanning direction perpendicular to the sheet transporting direction.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1A:
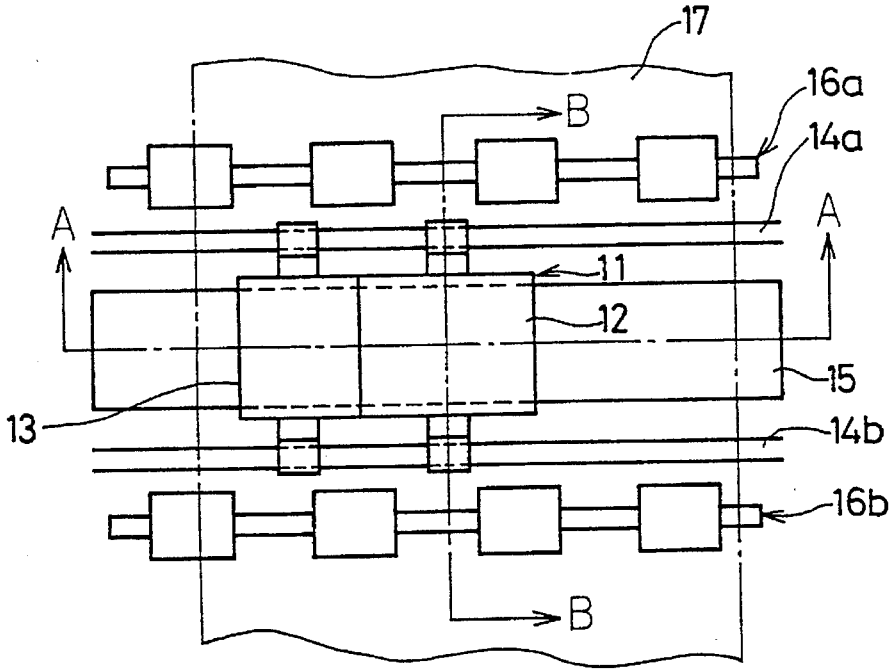
FIG. 1A is a plan view of a carriage related to the present invention.
Figure 1B:
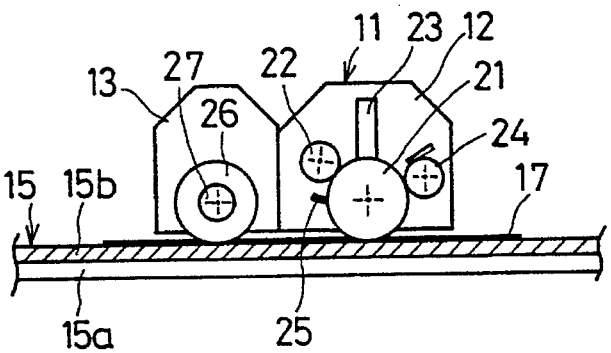
FIG. 1B is a cross-sectional view taken along line A—A shown FIG. 1A.
Figure 1C:
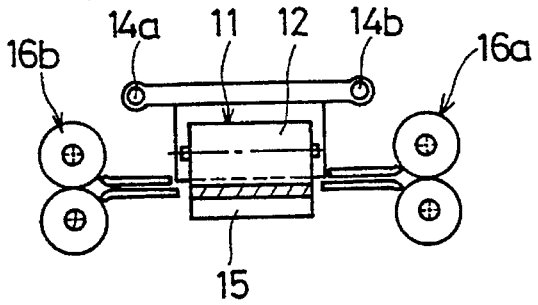
FIG. 1C is a cross-sectional view taken along line B—B shown FIG. 1A.

FIGS. 1A, 1B and 1C show a carriage of an electrophotographic printing machine related to the present invention. More particularly, FIG. 1 is a plan view of such a carriage, FIG. 1B is a cross-sectional view taken along line A—A shown in FIG. 1A, and FIG. 1C is a cross-sectional view taken along line B—B shown in FIG. 1A.

Referring to these figures, a carriage 11 includes a process unit 12 and a fixing device 13. The carriage 11 is moved, by means of a driving motor (not shown), above an image transfer device (print platen) in the main scanning direction perpendicular to the recording sheet transporting direction in such a manner that the carriage 11 is guided by shafts **14*a* and 14*b* extending in parallel. Two transport roller assemblies 16*a* and 16*b*, each having a plurality of rollers, are provided on either side of the carriage 11. A recording sheet 17 is transported between a transfer device 15 and the carriage 11 due to the function of the transport roller assemblies 16*a* and 16*b***.

The process unit 12 of the carriage 11 has a latent image carrier 21 which is rotated at a circumferential speed synchronized with the movement of the carriage 11. The surface of the latent image carrier 21 is evenly electrified by a charger 22, and electrostatic latent image is formed thereon by an exposing device 23. The electrostatic latent image is changed to a visible toner image by a developing roller 24. The toner image formed on the latent image carrier 21 is transferred on the recording sheet 17 by the transfer device 15 located opposite to the side of the recording sheet 17 on which the latent image carrier 21 is located. The toner particles remaining on the latent image carrier 21 are scraped off by a cleaner 25.

The surface of the latent image carrier 21 from which the remaining toner particles have been removed is electrified by the charging device 22 again, and the same printing process as described above is repeatedly performed. When printing of a predetermined width is completed, the recording sheet 17 is transported by a predetermined length by the transport roller assemblies 16*a* and 16*b*, and the carriage 11 is returned to the home position from which the carriage 17 perform next printing.

The image transfer by the transfer device 15 is performed by applying a predetermined voltage across the transfer device 15 and the latent image carrier 21. Hence, an electrically conductive member 15*b* made of, for example, electrically conductive rubber is provided on a base plate 15*a* of the transfer device 15.

The fixing device 13 has an image fixing roller 26, in which a heat source 27 such as a halogen lamp is provided by a heating means. The fixing roller 26 is pre-heated to a predetermined temperature by the heat source 27 before the printing operation by the process unit 12. During the printing operation, the temperature of the fixing roller 26 is detected by a temperature detector (not shown) such as a thermistor and is controlled by the detected temperature. That is, the fixing device 13 is moved together with the process unit 12, and the fixing is performed immediately after the transfer by the process unit 12.

Figure 2:
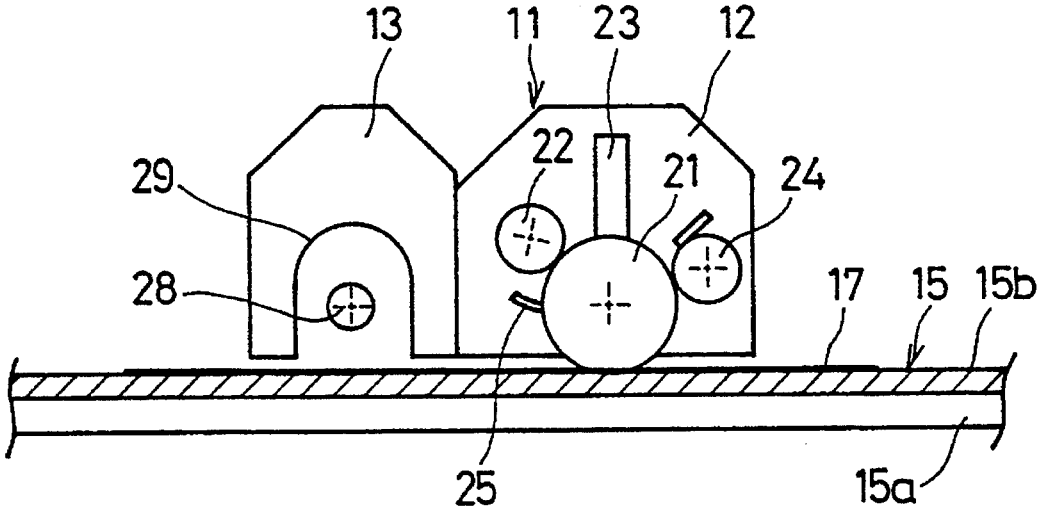
FIG. 2 is a cross-sectional view of another carriage related to the present invention.

FIG. 2 shows another carriage related to the present invention. In FIG. 2, parts that are the same as those shown in FIGS. 1A, 1B and 1C are given the same reference numbers. A halogen lump (infrared lamp) 28 is provided, as a heating means, in the fixing device 13 in the carriage 11. A reflection mirror 29 is provided around the halogen lamp 28. When the image transferred onto the recording sheet 17 is fixed thereto, the halogen lamp 28 of the fixing device 13 directly applies heat to the recording sheet 17. Since it is undesirable to have the temperature of the inner area of the process unit 12 raised, a light interrupting plate or a thermal insulation plate is used to thermally isolate the process unit 12 and the fixing unit 13 from each other.

It is necessary to make the above-mentioned carriage 11 compact because the printing direction of the carriage 11 corresponds to the main scanning direction and is moved every line. When continuous printing is performed, the temperature of the fixing device 13 becomes high and the temperature of the process unit 12 becomes high even when the thermal isolation plate or the like is used. Hence, a cooling device is needed to prevent the temperature of the process unit 12 from rising. However, the use of such a particularly cooling device prevents down-sizing of the carriage 11 and therefore the printing machine.

In the case where the roller fixing utilizing the fixing roller 26 is employed, it is necessary to apply a roller pressure as high as a few kilograms to the recording sheet 17. However, such a high roller pressure will cause oblique motion of the recording sheet 17 and/or scattering of toner particles due to vibrations of the fixing device 13. These phenomena degrades the printed image quality. In order to reduce this problem, it is necessary to reduce the roller pressure. However, a reduced roller pressure leads to unstable fixing.

The light projection radiation types as shown in FIG. 2 need a high-power halogen lamp 28 in order to ensure energy necessary for toner melting. However, such a high-power halogen lamp 28 increases the production cost of the printing machine, and needs an expensive high-power source.

The present invention are intended to eliminate the above disadvantages.

Figure 3A:
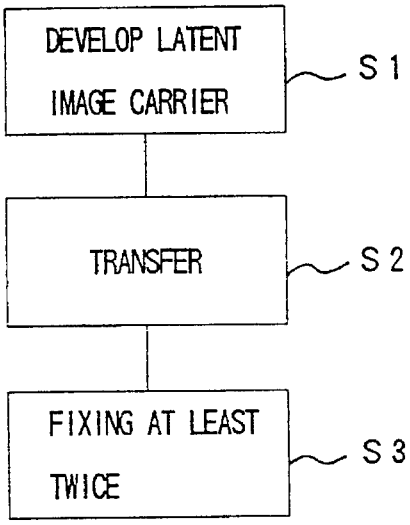
FIGS. 3A, 3B and 3C are flowcharts showing the principle of the present invention.
Figure 3B:
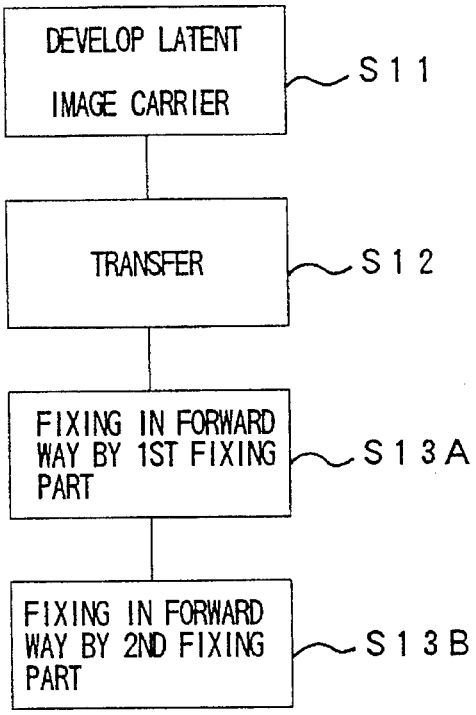
Figure 3C:
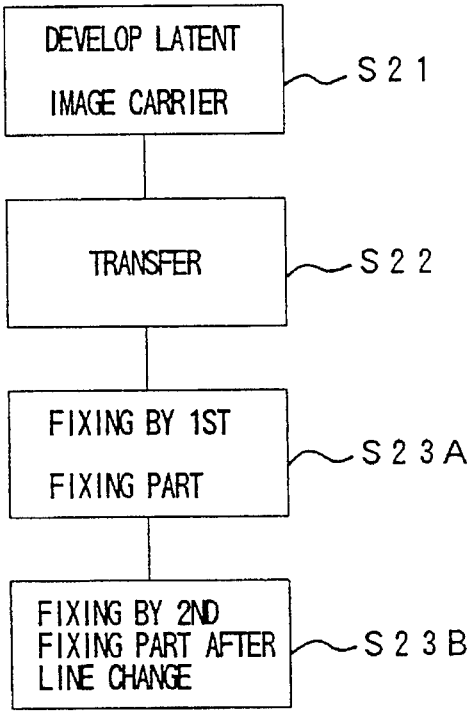

FIGS. 3A, 3B and 3C are flowcharts showing the principle of the present invention. In first step S1 shown in FIG. 3A, when a latent image carrier having a predetermined width is moved in the main scanning direction perpendicular to the direction in which a recording sheet is transported, a latent image is formed on the latent image carrier by electrifying it, and is then developed. In second step S2, the developed image is transferred to the recording sheet. In third step S3, a fixing operation on the image transferred onto the recording sheet image carrier is performed at least twice by means of a fixing device which is moved together with the latent image carrier and is heated by a heating means.

More particularly, step S3 is performed as shown in FIG. 3B, in which steps S11 and S12 are the same as the steps S1 and S2 shown in FIG. 3A, respectively. In steps S13A and S13B, a fixing device which includes first and second fixing parts arranged side by side in the main scanning direction is used. When the recording sheet is forwardly transported in the main scanning direction, the transferred image formed on the recording sheet is successively fixed thereto by the first and second fixing parts.

Alternatively, step S3 shown in FIG. 1A is performed as shown in FIG. 3C, in which steps S21 and S22 are the same as the steps S1 and S2 shown in FIG. 3A, respectively. Steps S23A and S23B utilize the above-mentioned fixing device including the first and second fixing parts. The transferred image formed on the recording sheet is fixed by the first fixing part when the recording sheet is forwardly moved, and is then fixed by the second fixing part when it is backward moved after starting the new line.

According to the present invention, the fixing operation is repeatedly performed two times or more. Hence, it is possible to set the temperature generated by the fixing device to be lower than the temperature set when the fixing operation is performed only once. As a result, a compact power source necessary to heat the fixing device can be used, and hence a compact fixing device can be formed. Further, the reduced temperature of the fixing device does not affect the process unit and hence the fixing operation can be stably performed.

Figure 4:
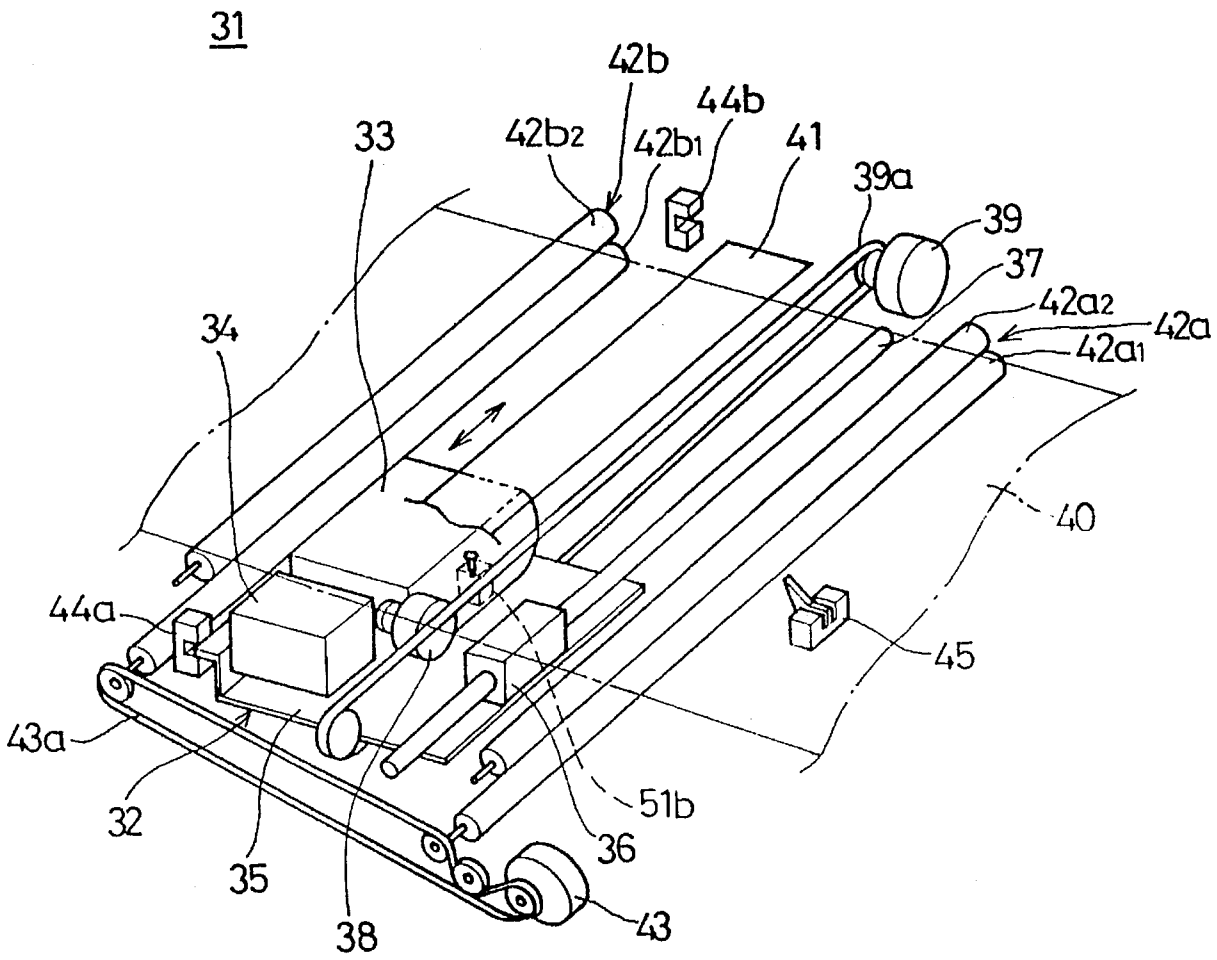
FIG. 4 is a perspective view of a printing machine according to a first embodiment of the present invention.

FIG. 4 is a perspective view of an electrophotographic printing machine 31 according to a first embodiment of the present invention. A carriage 32 (the details thereof will be described later) includes a process unit 33 and a fixing device 34, which are provided on a holding member 35 so that an opening for printing and fixing faces upward. A guide member 36 engaging a shaft 37 is provided to the holding member 35. The carriage 32 is guided by the guide member 36 engaging the shaft 37. A process motor 38 used to rotate a recording drum provided in the process unit 33 and a fixing roller provided in the fixing device 34 are provided on the holding member 35.

The carriage 32 is moved by a moving means including a belt 39*a* driven by a carrier motor 39 in the main scanning direction (indicated by the arrow shown in FIG. 4) perpendicular to the direction in which a recording sheet 40 is transported. A transfer device 41 (printing platen) located above the carriage 32 is provided as a transferring means.

The transfer device 41 is located on a base plate made of, for example, aluminum, and is formed of silicon rubber. The silicon rubber is located on the carriage 32 side and contains a heat-resistant electrically conductive member, such as carbon.

Two transporting roller assemblies 42*a* and 42*b* with the axial directions thereof equal to the main scanning direction are located on either side of the combination of the transfer device 41 and the carriage 32. The transporting roller assembly 42*a* is made up of two rollers 42*a*1 and 42*a*2, and the transporting roller assembly 42*b* is made up of two rollers 42*b*1 and 42*b*2. The transporting rollers 42*a*1 and 42*b*1 are rotated by a belt 43*a* driven by a transporting roller 43. The transporting roller assemblies 42*a* and 42*b*, the transporting roller 43 and the belt 43*a* form a transporting means. The recording sheet 40 is held between the rollers 42*a*1 and 42*a*2 and between the rollers 42*b*1 and 42*b*2, and is transported by rotating these rollers. The recording sheet 40 is located between the transfer device 41 and the carriage 32.

First and second photosensors (photodetectors) 44*a* and 44*b* are arranged side by side in the movement direction of the carriage 32, and limit the movement range when detecting the holding member 35. A sheet sensor 45 used to detect the leading and trailing ends of the recording sheet 40 are provided as shown in FIG. 4.

Figure 5:
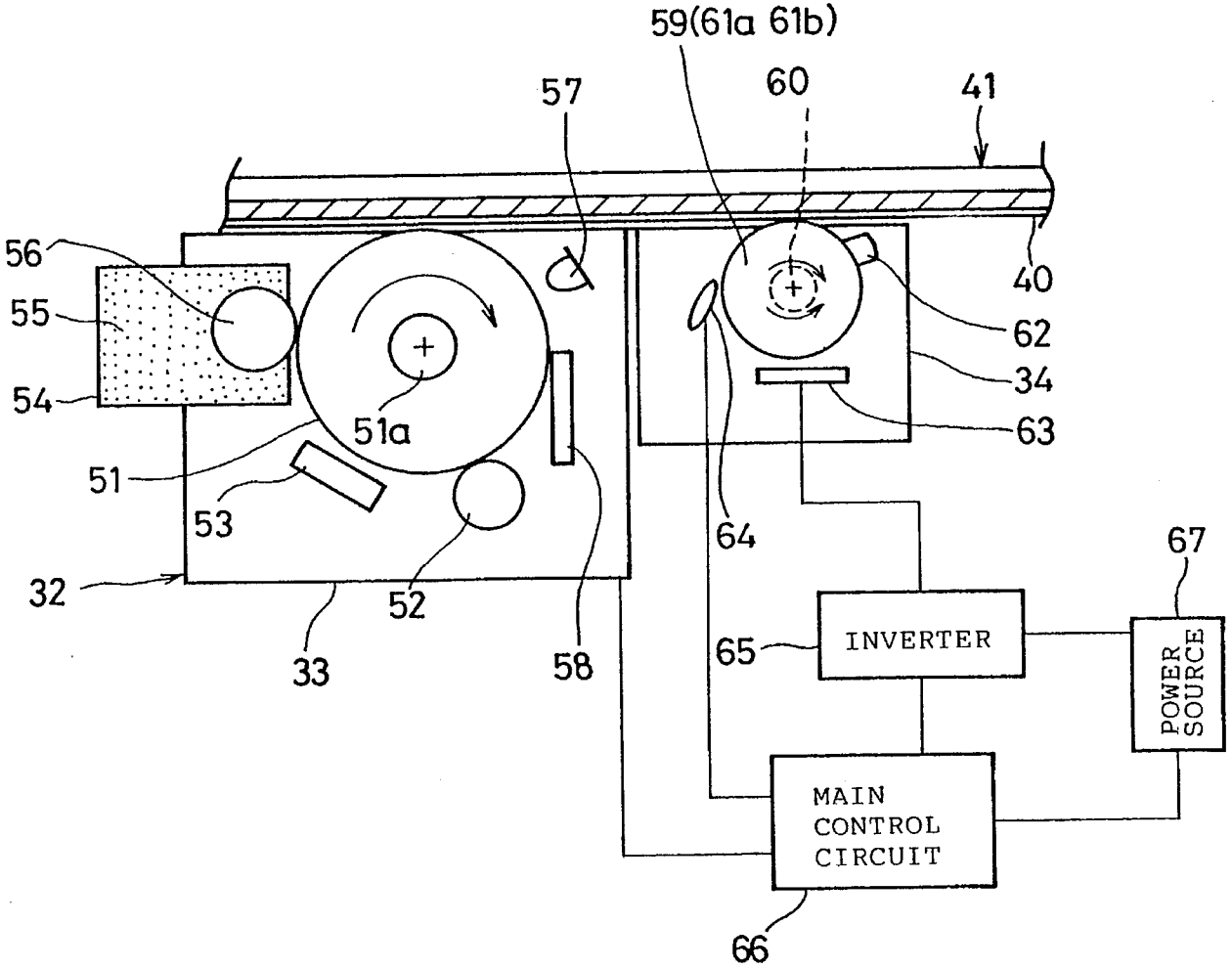
FIG. 5 is a diagram of a carriage shown in FIG. 4.

FIG. 5 shows an example of the structure of the carriage 32 shown in FIG. 4. As has been described previously, the carriage 32 is made up of the process unit 33 and the fixing device 34. The process unit 33 has a recording drum 51, which is a latent image carrier and has an axis parallel to the transporting direction of the recording sheet 40. The drum 51 is rotated on the recording sheet 40 above the fixing device 41 at a circumferential speed synchronized with the movement of the carriage 32.

The surface of the recording drum 51 is evenly charged by an exposing (charging) device 53, and an electrostatic latent image is formed thereon. This electrostatic latent image is converted into a visible toner image by means of a developing roller 56 carrying toner particles in a developing device 54 to the recording drum 51. The toner image formed on the recording drum 51 is transferred, as a recorded image, on the recording sheet 40 by applying a predetermined voltage between the recording drum 51 and the fixing device 41 on the side of the recording sheet 40 opposite to the side thereof on which the recording drum 51 is provided.

After the image transfer process is completed, the recording drum 51 is electrically discharged by a discharging device 57. Then, toner particles remaining on the recording drum 51 is scraped off by a cleaner 58.

As shown in FIG. 4, a solenoid 51*b* is provided in the process unit 33 (it also may be provided outside the process unit 33). When the carriage 32 is returned to the predetermined position (home position), the solenoid 51*b* functions to rotate a rotating shaft 51*a* of the recording drum 51 to detach the recording drum 51 from the recording sheet 40.

The fixing device 34 includes a fixing roller 59 comprising a cylinder made of a magnetic material and coated with Teflon. The fixing roller 59 functions as the image fixing member. Further, the fixing device 34 has bearing units 61*a* and 61*b* provided on either side of a rotating shaft 60 of the fixing roller 59. The fixing roller 59, the aforementioned recording drum 51 and the developing roller 56 are rotated by the process motor 38 in synchronism with the movement of the carriage 32.

A coating device 62, which is provided for the fixing roller 59, coats silicon oil to the fixing roller 59 in order to facilitate detachment of the recording sheet 40 from the fixing roller 59. A heating device 63 and a thermistor 64 are provided in the vicinity of the fixing roller 59. The thermistor 64 senses the temperature of the fixing roller 59. The heating device 63 is driven by an inverter 65 functioning as a heat driving means. The inverter 65 is controlled by a main control circuit 66 functioning as a heating control means on the basis of a sense signal output by the thermistor 64. The inverter 65 and the main control circuit 66 are connected to a power source 67. The main control circuit 66 receives predetermined signals from the process unit 33.

More particularly, the temperature of the fixing roller 59 is sensed by the thermistor 64. When the temperature of the fixing roller 59 becomes equal to a set temperature, the main control circuit 66 stops heating. When the temperature of the fixing roller 59 becomes lower than the set temperature, the main control circuit 66 starts heating. The above heating ON/OFF operation is repeatedly carried out so that the temperature of the fixing roller 59 can be kept at the set temperature. Alternatively, it is possible to employ a multi-stage control process in which a heating mode, a keeping mode and a cooling mode are selected on the basis of the temperature of the fixing roller 59.

The fixing process is performed so that the fixing roller 59 is rotated on the recording sheet 40 when the carriage 32 is moved in two ways along the direction perpendicular to the sheet transporting direction. In the above fixing process, the temperature of the fixing roller 59 which is set when the carriage 32 is backward moved is selected so as to be lower than the temperature which is set when the carriage 32 is forward moved and which is lower than the temperature selected in the fixing process in which the fixing roller is moved in only one way (only moved forward). Since the fixing is performed during the forward and backward movements of the carriage 32, it becomes possible to select a fixing temperature lower than the fixing temperature selected in the one-way carriage movement and to prevent the recording drum 51 of the process unit 33 from being affected by the fixing temperature.

A description will now be given of the operation of the above-mentioned electrophotographic printing machine 31. Now, the carriage 32 is located in the predetermined position (home position) in which the first photosensor 44*a* senses the carriage 32. The fixing roller 59 of the fixing device 34 provided in the carriage 32 is set to the forward-movement temperature to be set when the carriage 32 is moved forward.

The recording sheet 40 is transported by the transporting roller assemblies 42*a* and 42*b*. The sheet sensor 45 detects the leading end of the recording sheet 40. Then, the recording drum 51 and the fixing roller 59 of the carriage 32 is rotated in the forward way along the main scanning direction at the circumferential speed synchronized with the movement of the carriage 32. Hence, the recording drum 51 and the fixing roller 59 are moved on the recording sheet 40.

During the above movement, an electrostatic latent image is formed on the recording drum 51 in the aforementioned manner, and is converted into a visible toner image by the developing process. Then, the toner image is transferred on the recording sheet 50 by means of the transfer device 51. Then, the fixing roller 59 of the fixing device 34 rotated together with the recording drum 51 performs the first stage of the fixing operation at the forward-movement temperature.

When the fixing operation on the recording sheet 40 in the forward direction is completed and the carriage 32 is sensed by the second photosensor 44*b*, the carrier motor 39 is rotated in reverse and the carriage 32 starts to be moved in the backward direction.

At this time, the process motor 38 is stopped, and the fixing roller 59 and the recording drum 51 become free of movement, so that the fixing roller 59 and the recording drum 51 are rotated by friction force with the recording sheet 40 due to the movement of the carriage 32. The fixing roller 59 may be rotated in reverse by rotating the process motor 38 in reverse. In this case, a one-way clutch or the like is used to prevent the movement of the recording drum 51 from being transferred. When the carriage 32 is moved backward, the solenoid 51*b* starts operating in order to detach the recording sheet 40 from the recording drum 51.

The second stage of the fixing operation is carried out by the fixing roller 59 at a first temperature, or a backward-movement temperature, while the carriage 32 is being moved backward. When the first photosensor 44*a* detects the carriage 32, the carrier motor 33 is stopped and the transporting motor 43 is driven to perform line feed. The above is repeatedly carried out.

As described above, the fixing is performed by performing the fixing operation twice (in other words, the two stages of the fixing operation), and hence it becomes possible to select the fixing temperatures in the two ways lower than the fixing temperature selected when the one-way fixing operation is performed and to prevent heat for fixing from being transferred to the recording drum 51. As a result, the stable fixing operation can be performed so that the recording drum 51 can be kept, without any particular cooling device, at a temperature which does not degrade the performance of the recording drum 51.

Figure 6:
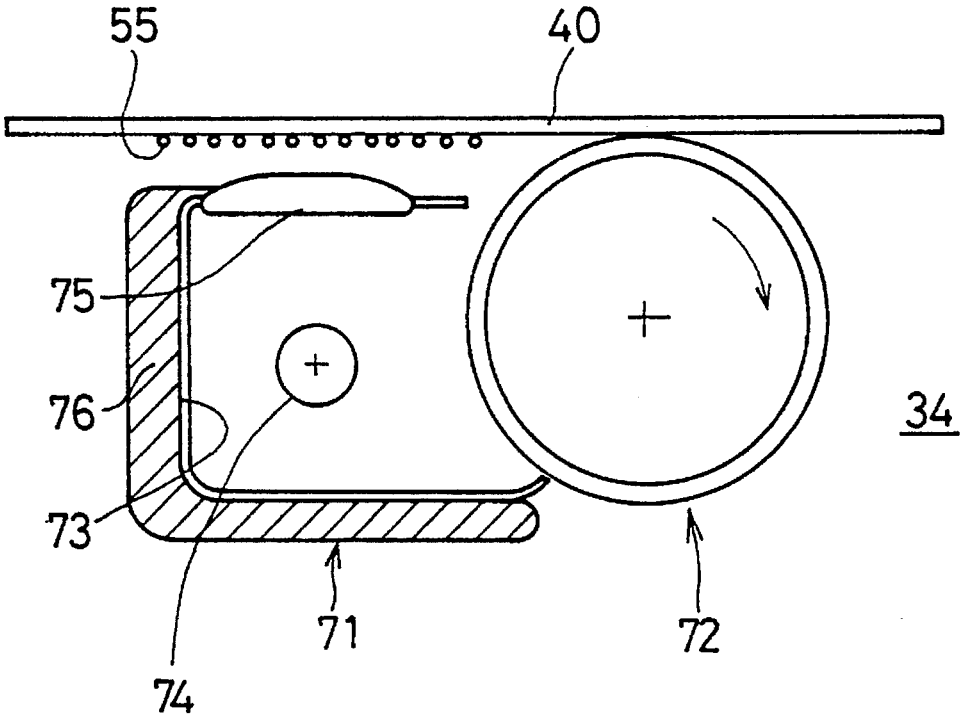
FIG. 6 is a diagram of an essential part of a second embodiment of the present invention.

A description will now be given, with reference to FIG. 6, of a second embodiment of the present invention. FIG. 6 is a schematic view of a fixing part provided in the fixing device 34 in the carriage 32 shown in FIG. 4 and configured according to the second embodiment of the present invention. Instead of the fixing roller 59 shown in FIG. 5, a fixing member 72 made up of a first part 71 and a second fixing part 72 is used as shown in FIG. 6. The process unit 33 and other structural parts of the second embodiment of the present invention are the same as those used in the first embodiment of the present invention.

The first fixing part 71 includes a reflection cavity 73 having an opening oriented in two directions, and a heat source 74 located in the reflection cavity 73 and formed with a halogen lamp or a cannon lamp. A lens 75 is provided in the opening part facing the recording sheet 40 on which the toner image has been formed by the toner particles 55. The other opening part facing in the other direction faces the second fixing part (fixing roller) 72. A protection layer 76 for thermal isolation made of, for example, silicon rubber, is provided on the outside of the reflection cavity 73. The first fixing part 71 and the second fixing part 72 are arranged side by side in the main scanning direction of the carriage 32 on the recording sheet 40. The thermal source 74 functions as not only a fixing member of the first fixing part 71 but also a heating means for heating the second fixing part 72.

In the first stage of the fixing operation of the fixing device 34, light emitted from the heat source 74 of the first fixing part 71 is collected by the lens 75, and is projected on the toner particles 55 forming a recording image transferred on the recording sheet 40. Hence, the toner particles 55 are heated and melted, and are fixed on the recording sheet 40. Toner particles in a part having a low toner density are sufficiently melted and remain therein because of the temperature difference between the toner particles and the recording sheet 40.

In the second stage of the fixing operation, the second fixing part (fixing roller) 7 heated by the heat source 74 melts the toner particles 55 which have not been sufficiently melted, and fixes them on the recording sheet 40. At this time, the first fixing operation has been performed, and hence the temperature of the roller surface may be lower than that for the prior art. Further, the pressure applied against the recording sheet 40 may be lower than that for the prior art.

The fixing device 34 used in the second embodiment of the present invention performs the fixing operation twice in one direction along the main scanning direction on the recording sheet 40. Alternatively, it is possible to perform the fixing operation in the opposite direction. In this case, the fixing operation is performed four times and the fixing temperature can be further reduced.

As describe above, by dividing the fixing operation into stages by the first and second fixing parts 71 and 72, it becomes possible to reduce the roller pressure against the recording sheet 40 and to prevent the oblique motion of the recording sheet 40 and scattering of the toner particles 55.

Figure 7:
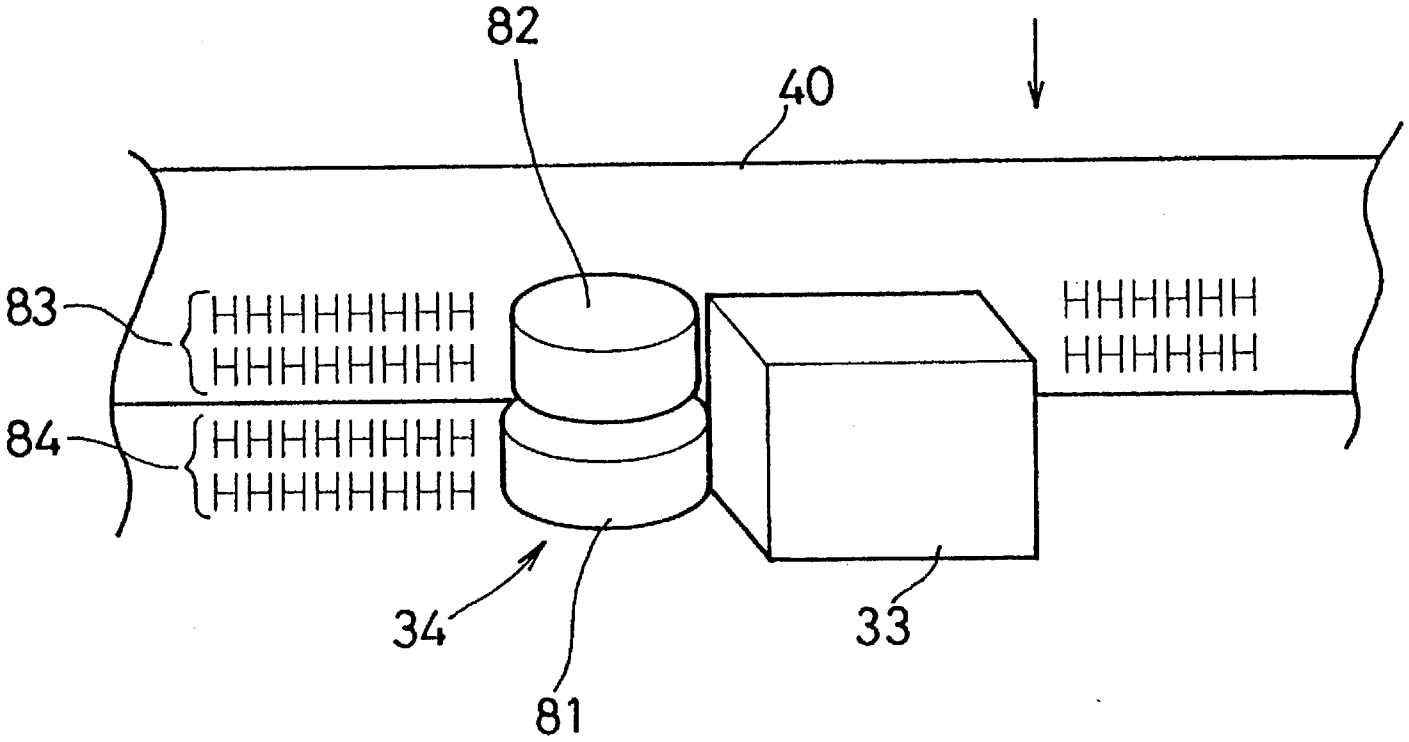
FIG. 7 is a diagram of an essential part of a third embodiment of the present invention.

FIG. 7 shows a part of a third embodiment of the present invention, and more particularly the relationship between structural parts of the carriage 32 and the recording sheet 40. The process unit 33 and other parts are the same as those of the first embodiment of the present invention.

Referring to FIG. 7, a first fixing roller 81 and a second fixing roller 82 provided in the fixing device 34 are arranged side by side in the direction in which the recording sheet 40 is transported. The fixing operation in the carriage 32 is as follows. First, a recording image is formed in a printing area 83 on the recording sheet 40 by the process unit 33 and the fixing device (which does not appear in FIG. 7). Immediately after this, the first stage of the fixing operation is performed by the first fixing roller 81. This fixing operation is performed only in a forward direction along the main scanning direction on the recording sheet 40.

When the recording image formation and the first stage of the fixing operation on the printing area 83 (one line) is completed, the transporting motor 43 is driven so that the recording sheet 40 is transported by a predetermined distance in the direction indicated by the arrow, whereby printing is changed to the next line. Thereafter, the fixing operation is performed in the same manner as described above. The second stage of the fixing operation is carried out for the printing area 83 to which the first stage of the fixing operation was performed before the line change.

In the above manner, the same recording image part is subjected to the fixing operation before and after line change. Hence, the fixing operation can be stabilized and the temperatures of the first and second fixing rollers 81 and 82 can be set lower than the conventional fixing temperature. As a result, the recording drum 51 of the process unit 33 is not affected by the fixing temperature, so that the fixing operation can be stably carried out.

The first and second rollers 81 and 82 can be heated by the heating unit 63 provided outside of the rollers as shown in FIG. 5. Hence, it is possible to reduce the diameters of the first and second fixing rollers 81 and 82, which leads to a reduction in the size of the overall fixing device 34.

The present invention is not limited to the specifically disclosed embodiments, and variations and modifications may be made without departing from the scope of the present invention.

What is claimed is:

1. A fixing method for a printing machine comprising the steps of:

(a) forming a latent image on a latent image carrier by a process unit during a time when the latent image carrier is moved in a main scanning direction substantially perpendicular to a direction in which a recording sheet is transported;

(b) transferring a visible image corresponding to the latent image onto the recording sheet; and (c) performing a fixing operation on the visible image on the recording sheet at least two times by a fixing device.

2. The fixing method as claimed in claim 1, wherein the step (c) comprises the step of performing the fixing operation at least two times when the fixing device are moved forward and backward together with the process unit in the main scanning direction.

3. The fixing method as claimed in claim 1, wherein the step (c) comprises the step of performing the fixing operation at least two times so that different fixing temperatures are applied to the visible image formed on the recording sheet.

4. The fixing method as claimed in claim 1, wherein the step (c) comprises the step of performing the fixing operation at least two times by means of at least two fixing parts of the fixing device arranged in the main scanning direction when the fixing device is moved forward and backward together with the process unit in the main scanning direction.

5. The fixing method as claimed in claim 1, wherein the step (c) comprises the step of performing the fixing operation at least two times by means of at least two fixing parts of the fixing device arranged in the direction in which the recording sheet is transported so that the visible image on the recording sheets are successively fixed thereon by said at least two fixing parts.

6. A printing machine comprising:

transporting means for transporting a recording sheet in a sheet transporting direction;

a carriage process means for forming a latent image on a latent image carrier, and fixing means for performing a fixing operation on a visible image transferred onto the recording sheet at least two times;

transfer means for transferring the visible image to the recording sheet so that the visible image is transferred onto the recording sheet; and moving means for moving said carriage in a main scanning direction perpendicular to the sheet transporting direction.

7. The printing machine as claimed in claim 6, wherein:

said fixing means comprises a single fixing roller having an axis extending in the main scanning direction; and control means for setting the single fixing roller to different fixing temperatures when said carriage is moved forward and backward in the main scanning direction.

8. The printing machine as claimed in claim 6, wherein:

said fixing means comprises a first fixing part and a second fixing part arranged in the main scanning direction;

the first fixing part performs the fixing operation when the carriage is moved forward in the main scanning direction; and the second fixing part performs the fixing operation when the carriage is moved backward in the main scanning direction.

9. The printing machine as claimed in claim 6, wherein:

said fixing means comprises a first fixing part and a second fixing part arranged in the sheet transporting direction; and the visible image on the recording sheet is successively fixed thereon by the first and second fixing parts while the recording sheet is being transported.

10. The printing machine as claimed in claim 8, wherein:

the first fixing part comprises a heat source, a reflection member reflecting light emitted by the heat source and a lens collecting the light and projecting the light onto the recording sheet; and the second fixing part comprises a roller.

11. The printing machine as claimed in claim 8, wherein the first fixing part comprises a heat source which heats the first fixing part itself and the second fixing part.

12. The printing machine as claimed in claim 8, wherein the first fixing part comprises a reflection member applying heat generated by the heat source to the second fixing part.

* * * * *